United States Patent [19]

Eaglin et al.

[11] Patent Number: 4,899,968

[45] Date of Patent: Feb. 13, 1990

[54] STORAGE AND ACCESS APPARATUS FOR CYLINDERICAL OBJECTS

[75] Inventors: David Eaglin, San Jose; Carlos O. F. Hinds, Hayward, both of Calif.

[73] Assignee: SCES Enterprises, Inc., San Jose, Calif.

[21] Appl. No.: 272,494

[22] Filed: Nov. 16, 1988

[51] Int. Cl.[4] ..... A47F 5/02

[52] U.S. Cl. ..... 248/131; 211/78

[58] Field of Search ..... 248/128, 129, 131, 415, 248/418, 311.2, 349, 146, 154; 211/78, 77, 71, 70; 108/103; 312/252, 305

[56] References Cited

U.S. PATENT DOCUMENTS

| | | | |
|---|---|---|---|
| 492,304 | 2/1893 | Markle | 211/70 |
| 678,612 | 7/1901 | Daemicke | 312/252 |
| 799,233 | 9/1905 | Hubbell | 312/305 |
| 2,750,051 | 6/1956 | Wassell | 211/78 |
| 3,197,096 | 7/1965 | Marcocchio | 312/305 |
| 3,331,515 | 7/1967 | Lange | 211/77 |
| 3,341,266 | 9/1967 | Schecter | 312/252 |
| 3,685,661 | 8/1972 | Kimmel | 211/70 |
| 3,791,403 | 2/1974 | Folkerth | 211/71 |
| 3,826,378 | 7/1974 | Novak | 211/70 |
| 3,981,405 | 9/1976 | Slack | 211/70 |
| 4,066,172 | 1/1978 | Howard | 211/78 |
| 4,168,007 | 9/1979 | Rohatensley | 211/71 |
| 4,438,853 | 3/1984 | Numbers | 211/77 |
| 4,453,326 | 6/1984 | Hoffman | 211/78 |

*Primary Examiner*—Ramon O. Ramirez
*Assistant Examiner*—Robert A. Olson
*Attorney, Agent, or Firm*—Michael J. Hughes

[57] ABSTRACT

A storage and access apparatus (10) is provided for containing and supporting elongated cylindrical objects, particularly industrial gas cylinders (13). The apparatus (10) operates on a principal similar to that of a lazy susan and includes a rotatable carousel (16) radially bounded by a stationary support frame (14). The entire apparatus (10) is supported on a base plate (18) which may be fixed to a specific location or carried on a rolling dolly (5120). The support frame (14) includes a base ring (20) for preventing radially outward slippage of the bottoms of the gas cylinders (13) and an upper support ring (30) mounted on support posts (26) for arresting the fall of a cylinder (13). The upper support ring (30) includes a gate member (34) for selectively closing a front gap (32) through which the cylinders (13) may be installed and removed. The rotating carousel (16) includes a center pillar (44) supporting a bottom plate (50) upon which the cylinders (13) are carried in a radial array of discrete chambers (52). Each chamber (52) is open on its radially outward side and includes vertical panels (56, 58 and 60) to provide lateral support. A corresponding array of receiving niches (78), closable by enclosing straps (88), laterally supports the upper portions of the cylinders (13). The carousel (16) rotates about a vertical axis (12) on a rotational support bearing (74) and upon peripheral rollers (64) attached to the bottom plate (50). A ratchet latch mechanism (66) is provided to permit the carousel (16) to rotate only in a single direction. An alternate embodiment (510), intended for use with shorter cylinders, includes both a bottom tier (5112) and a top tier (5114). The apparatus (10) and double tiered apparatus (510) are especially adapted for use in industrial applications using compressed gases.

19 Claims, 4 Drawing Sheets

STORAGE AND ACCESS APPARATUS FOR CYLINDERICAL OBJECTS

TECHNICAL FIELD

The present invention relates generally to material and equipment storage and delivery apparatus and more specifically to devices and storage facilities for massive cylindrical objects such as compressed gas cylinders.

BACKGROUND ART

The storage of cylindrical objects presents special problems, especially if the objects are such that they need to be stored on end. This problem is exacerbated when the objects are such that their axial length (height) is substantially greater than their diameter. In this case the base cross-section upon which the objects are to rest is small compared to the lever arm from the base point to the center of mass. A classic example of this type of cylinder is a common industrial compressed gas cylinder such as those used in welding and chemical delivery systems.

In order to achieve an acceptable method of storing gas cylinders and other elongated cylindrical objects which need to be stored in a vertical orientation for usage it is necessary to provide firm support to the objects while retaining accessibility and interchangeability. This is particularly true in the case of gas cylinders since the compressed gas contained therein is depleted and the cylinders need to be replaced with new or refilled units.

Traditionally, the methods of storing cylinders tend to be in the nature of vertical racks wherein the cylinders are supported laterally at position above their centers of mass by rails or racks and are either slid or rolled into position between the rails. Typically, the structures are in the nature of a set of rails along a wall where the cylinders are placed into the storage area and then removed one at a time through the ends of the rails for usage. A chain or block prevents movement within the rack and the force of one cylinder against another prevents the devices from tipping over.

One of the problems inherent in the rack and rail standing storage system is that it tends to be a last-in-first-out ("LIFO") system. This is especially true when deliveries of cylinders are made serially rather than simultaneously. The delivery personnel and storage personnel are typically unwilling to move the rearmost cylinders to the front when new ones are delivered and typically will place the new cylinders in front of those which are already stored within the facility. This means that those in the rear are often neglected for long periods of time and can lose potency and/or become a safety hazard. Another potential problem with the standard rack and rail wall storage is that there is no specific support for the bottom portions of the cylinders. This results in potential slippage of the bottom. Although the rails prevent lateral movement of the upper portions of the cylinders it is possible to move along the axis of the rails in such a way that a cylinder may tip if it is not chained in tightly. Particularly if the bottom portion of the cylinder slides forward along the floor in the direction of the rail axis, there is a danger that even a reasonably tight chain restriction will be insufficient since very little freedom of motion is needed at the upper portion of the cylinder to permit this type of sliding. Any sliding or other free movement of the cylinder is a great potential safety hazard, especially since many of the cylinders contain hazardous materials. Additionally, this method is only viable near vertical walls and is not adapted for use in open spaces.

Another common storage facility is a horizontal arrangement storage similar to that in a soda can dispenser device wherein the force of gravity pushes the lowermost cylinder to an accessible position while upper cylinders are retained within constricting rails of a rack-like device. This method has the advantage that the accessible cylinder is the one which was placed in the rack the least recently and also that the force of gravity is used to deliver the cylinder to the accessible position. However, it has the substantial disadvantage of horizontal storage, which is frequently non-optimal for use purposes. This method also has the disadvantage that the cylinders have to be lifted to a substantial height to be placed in the rack mechanism. Furthermore, since the transport of cylinders is almost exclusively in a vertical orientation there is substantial danger and opportunity for mishap in the steps of converting from the vertical to the horizontal orientation for placement in the rack mechanism.

The rolling horizontal storage system also has several inherent disadvantages. One of these is that it is not well adapted to storing cylinders of different types in the same array. That is because the bottommost cylinder is the one that must be removed before any others can be easily accessed. If this is not the cylinder desired then the user has a problem. Another difficulty is that the horizontal storage arrangement exposes the outlet valves located on the tops of the cylinders to a much greater degree of potential contact than a vertical arrangement. Since a shock to the valve area can cause accidental opening or even breaking off of the valve, thus opening the interior of the cylinder to the atmosphere and allowing the gas to escape. This is a hazard to be avoided if at all possible. This is especially true since the contents are often hazardous and since a broken top end of a cylinder may be explosively propelled at great force in the direction it is aimed. This is a further disadvantage of the horizontal array in that a laterally propelled valve mechanism stands a much greater chance of doing substantial damage to surrounding personnel and equipment than a vertically arrayed valve stem.

Various companies and individuals have made attempts to develop other methods of storing gas cylinders which provide a good balance of safety and accessibility but none of them entirely successful. Therefore, a great deal of room for improvement remains in this art.

SUMMARY OF THE INVENTION

Accordingly, it is an object of the present invention to provide a gas cylinder storage system which supports gas cylinders in a vertical array in an easily accessible manner.

It is another object of the present invention to provide a gas cylinder storage system which has multiple fail-safe support structures so as to prevent accidental slipping or tipping of the cylinders.

It is a further object of the present invention to provide a cylinder storage system which encourages operation in a first-in-first-out ("FIFO") manner while permitting the user to override this approach without undue hardship.

It is yet another object of the present invention to provide a cylinder storage system which minimizes the physical effort required from the user in switching from one cylinder to another.

It is a still further object of the present invention to provide a storage apparatus which may be shipped in a compact disassembled fashion while readily transforming into a sturdy storage unit with simple assembly procedure.

Briefly, the preferred embodiment of the present invention is an elongated cylindrical object storage and access system which is particularly adapted for use with industrial gas cylinders. The preferred embodiment of the present invention is an apparatus specifically adapted for use with tall cylinders while an alternate embodiment is adapted for use with half-sized shorter cylinders. The preferred embodiment is specifically adapted to contain and present four cylinders per unit with the intent that the user will utilize one of the units of the invention for each type of compressed gas cylinder in the user's operation.

The preferred embodiment includes a base plate which is adaptable to be anchored either to the floor or to a moving cart in such a manner that the base plate will remain horizontal to the ground and with good support. A rotating support carriage or carousel is mounted upon the base plate by way of a rotational support bearing structure which permits ready rotation of the support carriage while supporting the very substantial weight of the carriage and the cylinders themselves. The carousel is, in the preferred embodiment, symmetrical about two horizontal axes in that it has a bottom carousel module including four cylinder receiving chambers formed radially about a central vertical axis. Each of the support chambers is adapted for receiving and supporting the bottom of the gas cylinder from beneath and on three sides. A corresponding upper carousel module in the form of a support rack is provided axially above the support chambers for enclosing and supporting each of the cylinder in a position vertically upward from its center of mass. The upper support rack encloses three sides of the cylinder in a rigid manner and has a detachable closure about the fourth side so as to prevent any lateral movement of the upper portion of the gas cylinder when the closure is fastened. A stationary external support frame mounted on the base plate encloses the support carriage within a "fence" and further prevents any possible slippage or tipping of the cylinders. The external frame is all-enclosing but is in two arcical portions. These include a ring portion which encloses approximately three hundred degrees of a circle and a gate portion which extends across the ends of the upper part of the ring portion to further enclose the structure. The gate is structured in such a manner that the carousel may not be rotated when the gate is in the closed position since the elements of the gas cylinders will abut against the gate at discrete positions. The external frame includes a base ring surrounding the support chambers such that the bases of the cylinders cannot slip radially outward and upper ring is arrayed opposite the upper support racks to perform a similar purpose. The gate is provided on the upper ring while the base ring is open to the front.

A ratchet mechanism is provided to permit the support carriage to rotate in only a single rotational direction beyond certain discrete points, the discrete points corresponding to positions wherein the lateral plate portion of the gate is aligned between two of the support chambers so as to lie between two adjacent cylinders.

The first alternate embodiment discussed herein is similar in structure to the preferred embodiment except that it includes a second vertical layer or tier with an additional set of base support chambers and upper support racks with associated ring members. The first alternate embodiment is specifically adapted for use with the shorter cylinders utilized in some industrial applications.

It is an advantage of the present invention that the ratchet mechanism permits the support carriage to turn only in a single direction such that the user is forced to use a FIFO usage pattern unless a specific conscious effort is made to turn the carriage past the next available cylinder.

Another advantage of the present invention is that the rotational support bearing structure is balanced such that the mechanism supports the rotation of the carriage in a balanced manner whether all of the chambers are filled or not.

A further advantage of the present invention is that the gate structure prevents the carriage from being turned accidentally when the gate is closed.

Yet another advantage of the present invention is that it provides multiple fail-safe support for the cylinders, thus virtually eliminating any possibility of tipping or slippage except during the insertion or removal procedures.

A still further advantage of the present invention is that in the preferred embodiment the support chambers are situated only a short distance above the floor such that minimal lifting is required in the insertion and removal process.

Still another advantage of the present invention is that it has a relatively small footprint, in that it stores in a vertical manner and thus utilizes a small amount of floor space.

A still further advantage of the present invention is that it provides substantial lateral protection for the cylinders preventing potentially puncturing or damaging approaches from elements such as fork-lifts from directly reaching the cylinders in most cases.

Yet another advantage of the present invention is that it maintains and supports the cylinders in a vertical position even upon delivery of substantial shocks such as those present in earthquakes and industrial accidents.

A still further advantage of the present invention is that it may be easily disassembled for shipping and storage.

These and other objects and advantages of the present invention will become clear to those skilled in the art upon review of the following specification, the accompanying drawings, and the appended claims.

BEST MODE OF CARRYING OUT THE INVENTION

The present invention is a storage and access apparatus particularly adapted for use in containing elongated cylindrical objects. The invention is a lazy susan or carousel type device which utilizes a support carriage rotating about a central axis. It is particularly adapted for storage and presentation of industrial gas cylinders.

Figure 1:
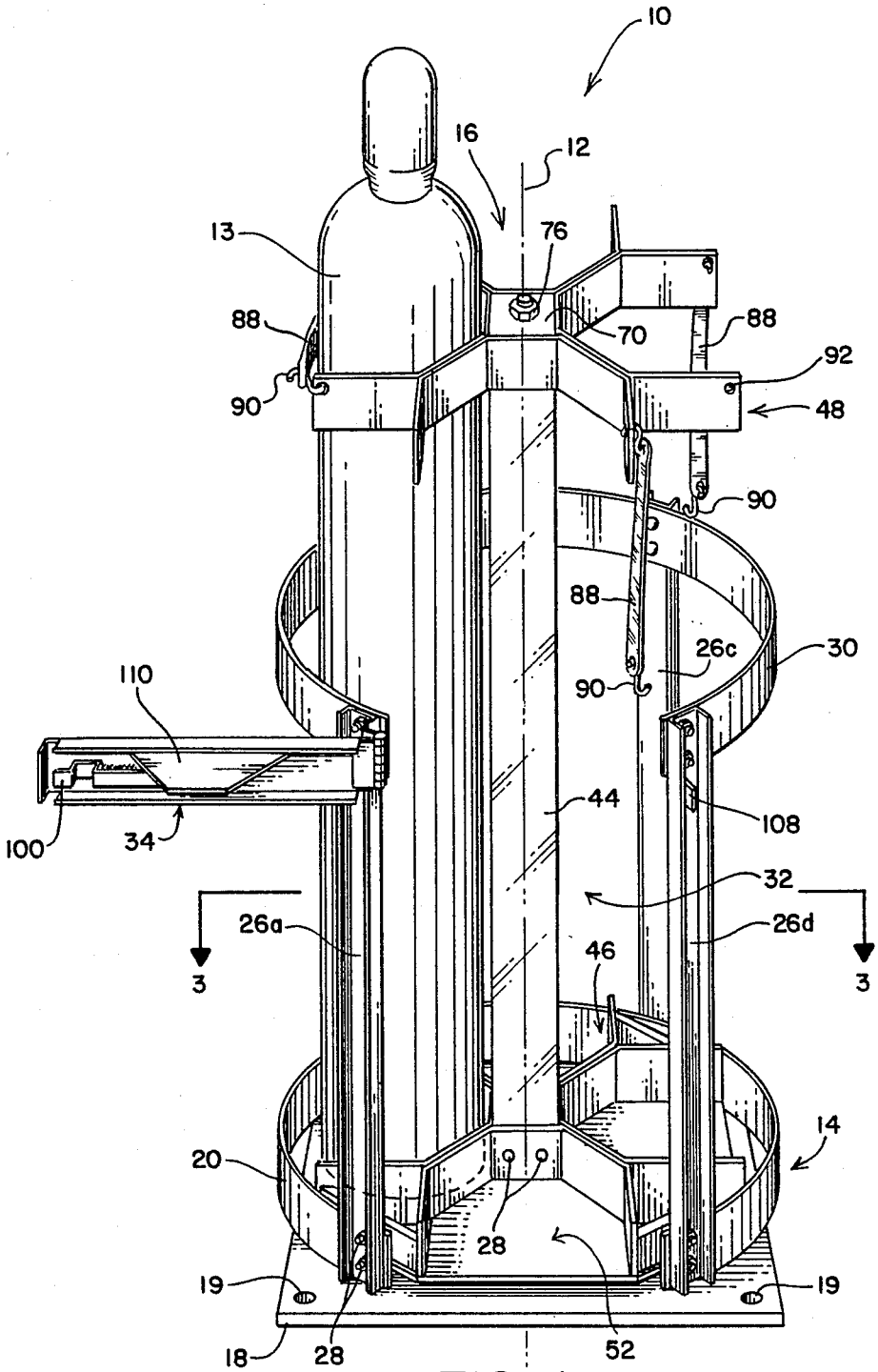
FIG. 1 is a perspective view of the preferred embodiment of the elongated cylindrical object storage and access apparatus of the present invention.

The preferred embodiment of the storage and access apparatus of the present invention is illustrated in a perspective view in FIG. 1 and is designated by the general reference character 10. It may be seen that the apparatus 10 is generally symmetrical about a vertical central axis 12. The apparatus 10 is shown as supporting a typical gas cylinder 13. The apparatus 10 includes a stationary frame component 14 and a carousel component 16, with the carousel component 16 rotating about the central axis 12. The stationary frame 14 is situated exterior to the carousel portion 16 and does not generally interfere with the rotation thereof.

Figure 2:
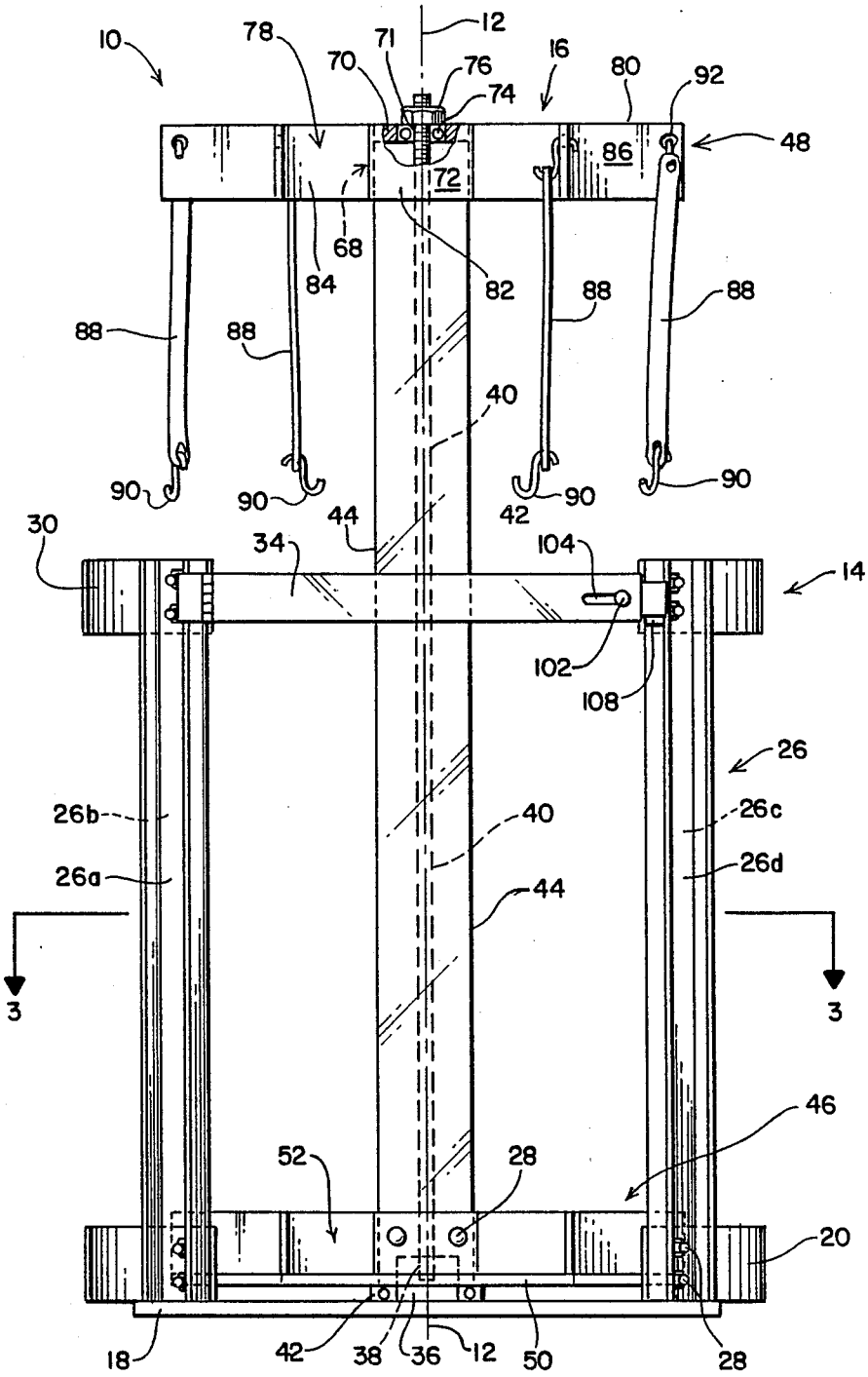
FIG. 2 is a front plan view of the preferred embodiment.
Figure 3:
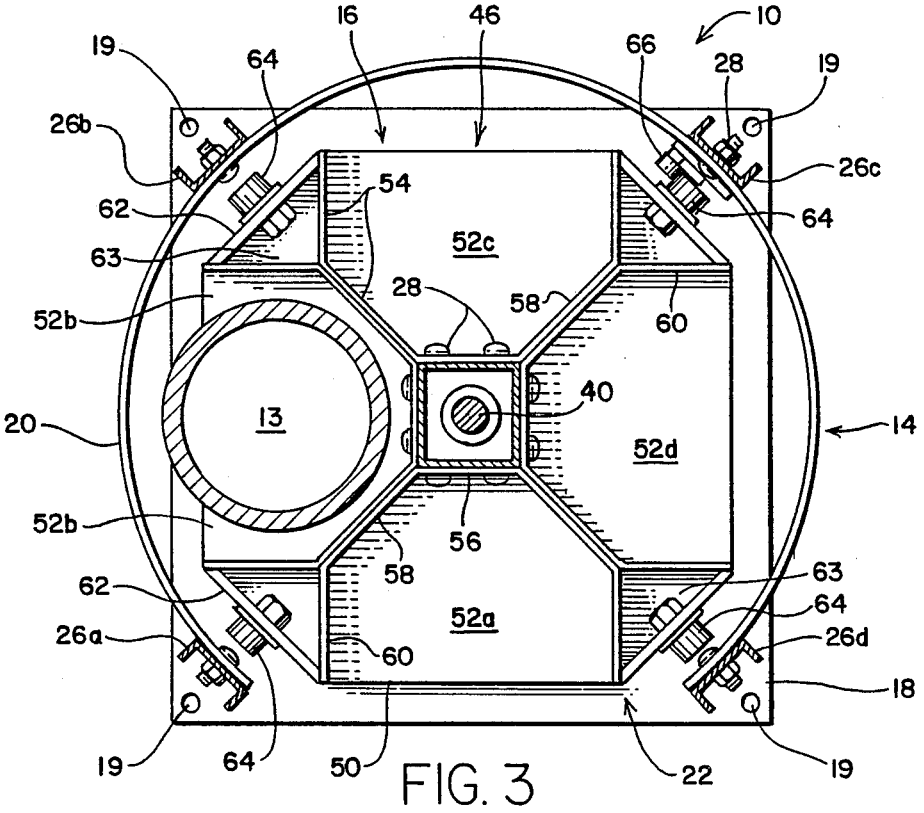
FIG. 3 is a cross-sectional view taken along lines 3—3 of FIGS. 1 and 2.

The construction of the storage access apparatus 10 of the preferred embodiment is best understood by an analysis in view of FIGS. 1, 2 and 3. These illustrations show the apparatus 10 in perspective, front plan and cross-sectional views, respectively, in which all of the significant components may be understood.

The stationary frame 14 provides the support for the apparatus 10 and anchors the apparatus 10 to the floor or other surface upon which it is to be mounted. A base plate 18, having a substantial footprint to provide stability against tipping forces, provides the bottommost element of the apparatus 10. As is best seen in FIG. 3, the base plate 18 includes, at the corners thereof, a set of mounting apertures 19 by which the base plate 18 may be bolted to the floor or to another device such as a rolling dolly. Alternatively, the base plate 18 may be held in position by an adhesive or it may be relied on to hold its position due to the weight of the apparatus 10, with the associated contents.

A base ring member 20 is mounted upon the base plate 18 to provide an enclosing ring over approximately 300° of arc. The remaining 60° of arc comprises a front opening 22 through which the gas cylinders 13 may be inserted into the carousel 16. The base ring member 20 is secured to the base plate 24 by welding or a similar attachment method.

In the preferred embodiment 10 the support frame 14 further includes four vertical support posts 26 which are symmetrically mounted at the corners of the base plate 18 and are welded thereto. The preferred array of support posts 26 includes a first post **26*a*, a second post 26*b*, third post 26*c* and a fourth post 26*d* (see especially FIG. 3). In the preferred embodiment, each of the support posts 26 is a rigid U-beam type of post which is further secured to the base ring 20 by a pair of vertically displaced securing bolts 28. The securing bolts 28 maintain the vertical alignment of the support posts 26** and provide enhanced structural stability in addition to the welding.

The support posts 26 extend vertically upward from the base plate 18 to a position slightly above the center of mass of the typical gas cylinder 13. At the upper end of the support posts 26, a further group of securing bolts 28 attach each post 26 to an enclosing support ring 30. The enclosing support ring 30 is substantially similar to the base ring 20 in that it encloses approximately 300° of arc and includes a front gap 32. The front gap 32 of the enclosing support ring 30 is adapted to be closed by a gate member 34 which extends directly in a straight line across between the ends of the enclosing support ring 30. The structure of the gate member 34 is shown in the detailed view of FIG. 4 and discussed with respect thereto.

The stationary frame 14 further includes the support structure upon which the carousel 16 is mounted. The first of these components is a seating column 36, see FIG. 3, which is welded to the base plate 18. The seating column 36 has a central axial threaded aperture 38 which reCeives the bottom end of an elongated center post 40 which extends upward along the center axis 12. In the preferred embodiment 10 the center post 40 is threaded along its entire length. A thrust bearing 42 is provided about the seating column 36 to support the weight of the carousel 16 and to permit it to rotate freely about the central axis 12.

The structure of the carousel subassembly 16 is also best understood from consideration of FIGS. 1, 2 and 3 taken together. The carousel 16 is mounted so as to rest upon the thrust bearing 42 and about the central post 40 in a manner such that it may rotate about the central axis 12 while retaining complete lateral and vertical immobility. The primary vertical component of the carousel 16 is a center pillar 44. In the preferred embodiment 10 the center pillar 44 is an elongated hollow member having a square cross-section. The length of the center pillar 44 is selected such that it extends to a point just short of the top of the center post 40.

The center pillar 44 provides support for a lower carousel module 46 and an upper carousel module 48. The lower carousel module 46 provides the support for the bases of the gas cylinders 13 while the upper carousel module provides lateral support to the upper portions of the cylinders 13.

The bottom carousel module 46 of the preferred embodiment includes a bottom plate 50 in the form of an irregular octagon (See FIG. 3). The bottom plate 50 provides the vertical support for four radially arrayed support chambers 52. In the illustration of FIG. 3, the support chambers are designated as the first support chamber **52*a*, a second support chamber 52*b*, a third support chamber 52*c*, and a fourth support chamber 52*d*. Since the lower carousel module 46 is radially symmetrical about two normal axes, each of the support chambers 52** is equivalent in shape and construction.

Each of the support chambers 52 includes a vertical plate 54 which is bent into a modified block "U" shape so as to have a back panel 56 adjacent to the wall of the center pillar 44, a pair of angle panels 58 extending at a 45° angle outward therefrom and a pair of side panels 60 extending at an additional 45° angle from the ends of the angle panels 58, such that the side panels 60 are parallel to the sides of the center pillar 44. The vertical plate 54 is welded or otherwise firmly attached to the bottom plate 50 and the back panels 56 are attached to the center pillar 44 by an additional pair of securing bolts 28. The entire lower carousel module 46 is constructed so that the bottom plate 50 and the vertical plates 54 slide about the center pillar 44 in such a manner that the carousel 16 may be readily disassembled. For assembly, the lower carousel module 46 is simply slid over the center pillar 44 until it is in position and is then bolted securely to the center pillar 44 by the securing bolts 28, as shown in FIGS. 1 and 3 particularly. The end user may wish to actually weld the elements together for additional strength. The net effect of the bending of the vertical plate 54 is to create a generally U-shaped sidewall for each of the support chambers 52. It is noted that, in the vicinity of the angle panels 58, a double wall exists since angle panels 58 from adjacent vertical plates 54 are aligned with each other.

The lower carousel module 46 provides the means for the actual support and positioning of the gas cylinders 13. In the illustration of FIG. 3 it may be seen that the base of the typical gas cylinder 13 rests upon the bottom plate 50. The U-shaped vertical plate 54 provides support to the lower side portions of the gas cylinder 13 while the back of the cylinder 13 is supported along a substantial portion of its height by the central column 44. In this illustration it may be seen that each of the support chambers 52 is open to its relative front. The orientation of the support chambers 52 in FIG. 3 is the orientation which would be selected in loading the cylinders into the apparatus 10. In this illustration one of the functionally equivalent support chambers, designated arbitrarily as the first chamber 52*a*, is aligned with the front opening 22. This facilitates lifting one of the cylinders 13 into the apparatus 10 and placing it on the accessible support Chamber 52*a*.

In addition to the rotational support provided to the carousel 16 by the thrust bearing 42, additional balancing and rotational support is provided by a plurality of mechanisms arranged about the lower carousel module 46. As is especially seen in FIG. 3, the exterior ends of the adjacent side panels 60 are connected by a connecting plate 62 to form a triangular area 63 between the adjacent support chambers 52. The connecting plates 62 are the same height as the vertical plates 54 and are welded thereto and to the bottom plate 50. The connecting plate 62 provides support for roller members 64 which extend outward therefrom. Each roller member 64 is adapted to extend beyond the bottom plate 50 and downward such that it will roll upon the base plate 18. The four rollers 64 provided in the preferred embodiment 10 provide a balanced support to the carousel 16 and also facilitate the rotation of the carousel 16 on the thrust bearing 42. The preferred rollers 64 are in the form of cam following bearings.

The rollers 64 are adapted to roll on the base plate 18 in a circular fashion, and at one point on the base plate 18 to engage a ratchet latch mechanism 66. In the illustration of FIG. 3, the ratchet latch mechanism 66 is shown as being attached to the base ring 20 at a location adjacent to the third support post 26*c*. However, the precise positioning of the ratchet latch mechanism 66 is not critical to operation. It is simply preferable to have it adjacent to one of the four support posts 26 for a firmer connection.

The purpose of the ratchet latch mechanism 66, which in the preferred embodiment 10 is in the form of a directional control latch, is to allow the rollers 64 to rotate past the ratchet latch mechanism 66 in one direction but to prevent a reverse rotation. In the illustration FIG. 3, only clockwise rotation of the carousel 16 is permitted by the interaction of the rollers 64 with the ratchet latch mechanism 66. This ratchet interaction is desirable in that it forces the user to use a FIFO usage pattern since the carousel can only be turned in a single direction and the user must make a conscious effort to turn past the next available cylinder, which will be the least recently installed. For this method to be most effective it is desirable to align the apparatus 10 such that the fourth support chamber 52*d* contains the cylinder 13 actually in use.

The upper carousel module 48 is adapted to be installed on the center pillar 44, at its upper end. The upper carousel module 48 is in the form of a top rack which provides lateral support to the upper portions of the gas cylinder 13. The central portion of the upper carousel module 48 is a top cap 68 which is adapted to fit over the upper end of the center pillar 42. The top cap 68 is formed to include a top plate 70 which extends over the opening at the top of the center pillar 44 and prevents debris from entering therein. The top plate 70 includes in the center thereof a bolt aperture 71 that permits the center post 40 to extend therethrough. An integral portion of the top cap 68 is a set of four side plates 72 which extend a short distance down each of the sides of the center pillar 44. The side plates are firmly attached to each other and to the top plate 70 such that the top cap 68 is firmly supported on the upper end of the center pillar 44.

A rotational support bearing 74 is provided at the bolt aperture 71 about the center post 40. The rotational support bearing 74 provides additional support to the rotation of the carousel 16 about the central axis 12. The top cap 68 is firmly held in position by tightening a top nut 76 down upon the center post 40. The tightening of the top nut 76 prevents any movement of the carousel 16 along the central axis 12 and maintains a firm contact between the bottom of the center pillar 44 and the thrust bearing 42 and also on each of the rollers 64.

Except in that it has a top cap 68 and no bottom plate 50, the upper carousel module 48 is substantially congruent to the lower carousel module 46. Corresponding to the support chambers 52 are a series of four receiving niches 78. The receiving niches 78 are aligned directly above the support chambers 52. Since both the upper carousel module 48 and the lower carousel module 46 are firmly attached to the center pillar 44 they will rotate concurrently therewith and the alignment between the support chambers 52 and the receiving niches 78 will be maintained throughout.

Similarly to the construction of the support chambers 52, the receiving niches 78 are formed by bending a flat plate 80 for each of the niches. A flat plate 80 is provided for each of the niches 78 and is bent to include a back wall 82, a pair of angle walls 84 and a pair of side walls 86. The receiving niches 78 are open to the front except that the front end of the side walls 86 on one side of each receiving niche 78 are provided with an enclosing strap 88 having a hook 90 on the opposite end. The hook 90 is adapted to mate with a hook aperture 92 formed in the side wall 86 on the opposite side of the receiving niche 78. When a gas cylinder 13 has been placed so that its upper portion is within the the receiving niche 78, the enclosing straps 88 is extended across the opening with the hook 90 engaging the hook aperture 92 such that the cylinder 13 is completely enclosed by the top rack 48. In the preferred embodiment the enclosing straps 88 are selected to be rubberized or elastic straps having sufficient strength to provide support to the upper portions of the gas cylinder 13 but being slightly elastic such that they must be stretched in order to have the hook 90 engage the hook aperture 92. This elasticity prevents the hook 90 from becoming accidentally dislodged from the hook aperture 92.

Figure 4:
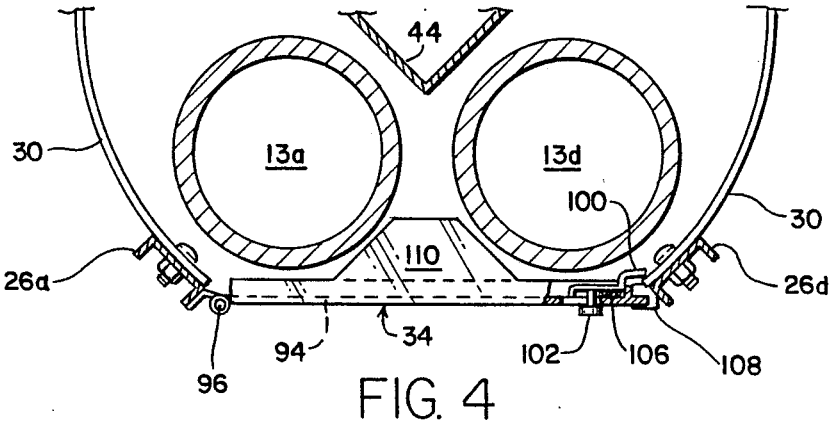
FIG. 4 is a top detail view of the gate mechanism.

The gate mechanism 34 is shown in detailed view in FIG. 4 with various of the components being more clearly understood from references to FIGS. 1 and 2. In the preferred embodiment 10, the gate mechanism 34 includes a vertical gate plate 94 which is attached to the enclosing support ring 30 at the end thereof nearest the first support post 26*a*by a hinge 96. The gate plate 94 extends across the front gap 32 and, in the closed position as shown in FIG. 4, abuts against the end of the enclosing support ring 30 nearest the fourth support post 26*d*. Thus the length of the gate plate 94 is slightly greater than the width of the front gap 32. This prevents the gate mechanism 34 from being closed to a position beyond the front gap 32.

A latch mechanism 98 is provided at the end of the gate plate 94 opposite the hinge 96. The latch mechanism 98 is adapted to hold the gate 34 in a closed position when desired. The latch mechanism 98 includes a latch plate 100 on the interior side of the gate plate 94. The latch plate 100 of the preferred embodiment 10 is bent so as to extend inward beyond the inner surface of the enclosing support ring 30. In the closed position shown in FIG. 4 the end of the latch plate 100 extends on the interior side of the support ring 30 to a position beyond its end. This prevents the gate from being opened when the latch plate 100 is in this position.

The latch mechanism 98 is further provided with a latch knob 102 extending through a slot 104 formed in the gate plate 94. The slot 104 extends laterally along the axis of the gate plate near the end opposite the hinge 96. The latch knob 102 is rigidly attached to the latch plate 100 so that the two components move together. A biasing spring 106 is provided to bias the latch knob 102 toward the end of the slot 104 nearest the near end of the latch plate 94 in such a manner that the latch mechanism 98 is urged to the closed position. The user may apply a force on the latch knob 102 opposed to the bias spring 106 in order to slide the latch plate 100 to a position where it no longer engages the end of the enclosing support ring 30 such that the gate 34 may be opened.

A resting protrusion 108 is attached to the support ring 30 at a position which is just below the end of the latch plate 94 when the gate mechanism 34 is in the closed position. The rest protrusion 108 serves the purpose of supporting the end of the gate plate 94 such that the weight leverage does not produce an undue strain on the hinge 96 when the gate is closed.

A lateral plate 110, in the form of a trapezoid, is attached to the interior surface of the gate plate 94 to extend into the interior of the apparatus 10. As is shown in FIG. 4, the lateral plate 110 extends into the space between two of the adjacent gas cylinders 13*a* and 13*d* when the apparatus 10 is fully loaded. The lateral plate 110 prevents the carousel 16 from being rotated when the gate mechanism 34 is in the closed position. This again forces the user to make a conscious decision to rotate a cylinder beyond the usage position of the cylinder designated as 13*d* in FIG. 4 if the user desires abandon the first-in-first-out method in a particular instance. The comparison of FIGS. 3 and 4 indicates that the loading position illustrated in FIG. 3 and the use position illustrated in FIG. 4 are offset from each other by 45° of rotation.

Figure 5:
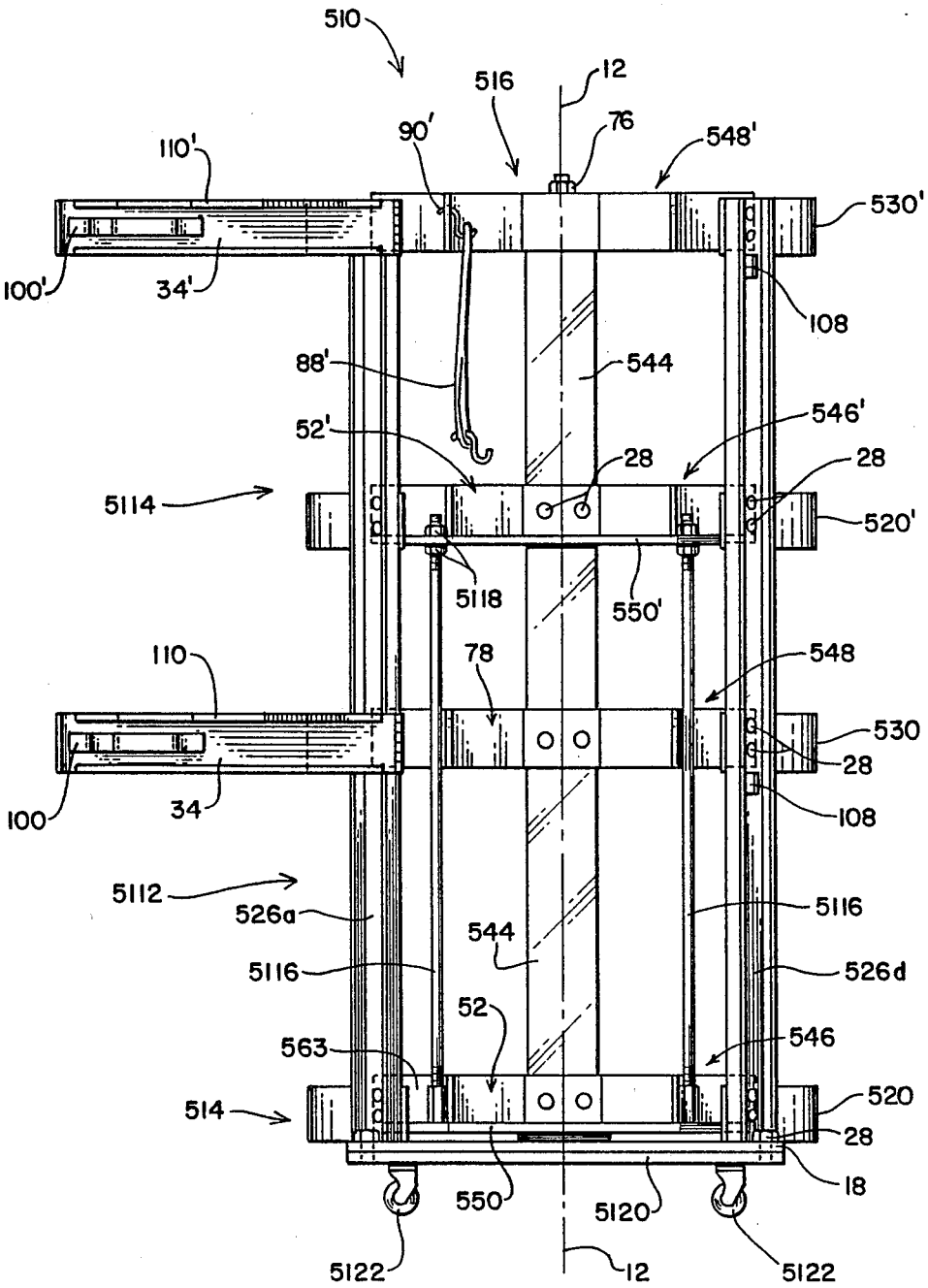
FIG. 5 is a front plan view of a first alternate embodiment of the present invention, adapted for use with shorter cylinders.

A first alternate embodiment of the invention is illustrated in FIG. 5, in a front plan view. The alternate embodiment is a double tiered storage apparatus referred to by the general reference character 510. By convention, the components and elements which are common to both the preferred embodiment 10 and the alternate embodiment 510 will retain their same reference numbers as shown in FIGS. 1–4. Elements which are altered in the alternate embodiment 510 but have corresponding elements in the preferred embodiment 10 are designated by their prior designation number proceeded by the digit 5. Elements which are new in the alternate embodiment 510 will also have numbers beginning with the digit 5 but will not have corresponding suffixes within the preferred embodiment 10.

As shown in FIG. 5, the doubled tiered storage apparatus 510 includes a bottom tier 5112 and a top tier 5114. The two tiers 5112 and 5114 are substantially similar in construction and each is adapted to receive a shorter variety of gas cylinder than that intended to be contained by the preferred embodiment 10. In the alternate embodiment 510 the second tier 5114 is situated vertically above the top of the alternate gas cylinders which are to be stored in the bottom tier 5112.

Each of the carousel portions of bottom tier 5112 and the top tier 5114 is constructed in a fashion which is very similar to the construction of the entire preferred embodiment 10. The components are simply duplicated. A second set of the alternate lower carousel module 546 and the alternate upper carousel module 548 (designated respectively as 546' and 548') are provided near the upper end of the center pillar 544. The alternate lower carousel module 546 is supported, in addition to being attached to the center pillar 544 by the connecting bolts 28, by a set of four support columns 5116. The support columns 5116 extend from the triangular area 63 of the first lower carousel module 546 directly upward to the four triangular areas 63' of the second lower carousel module 546'. The support columns 5116 of the alternate embodiment 510 are in the form of rigid metal shafts threaded at both ends and attached to the bottom plates 550 and 550' by securing nuts 5118. The securing nuts 5118 corresponding to the second lower carousel module 546' attach both above and below the bottom plate 550' such that the vertical separation between the two tiers of the alternate embodiment 510 is maintained thereby. The support columns 5116 are necessary since the gas cylinders to be utilized in the top tier 5114 are heavy elements and could place an undue strain on the connecting bolts 28 attaching the carousel module 546' to the center pillar 544.

Another difference between the preferred embodiment 10 and the alternate embodiment 510 is that the enclosing support rings 530 and 530' are vertically aligned with the corresponding upper carousel modules 548 and 548' rather than offset below as in the preferred embodiment 10. In the preferred embodiment the vertical separation provides support for the cylinders in lateral directions at three different points in a fail-safe situation. Because of the shorter vertical height of the cylinders utilized in the alternate embodiment 510 this degree of protection is not required and the direct alignment mode shown in FIG. 5 is permissible.

The alternate embodiment 510 is shown as being mounted upon a rolling dolly 5120. In this instance the base plate 18 is attached to the rolling dolly 5120 by securing bolts 28 extending through the mounting apertures 19. The rolling dolly 5120 is provided with casters 5122 to allow the entire apparatus 510 to be readily moved from one location to another for varied usages. Of course, a device such as the rolling dolly 5120 could be utilized with the preferred embodiment 10 as well.

Since the preferred embodiment of the storage and access apparatus 10 and the alternate embodiment 510 are adapted to be utilized in industrial situations the construction thereof is selected primarily for strength and durability, therefore, the majority of the components are structural steel. In the preferred embodiment 10 the dimensions of the apparatus 10 are such that it has a total overall height of approximately 116 cm (46.25 in) and a diameter of approximately 65.3 cm (26 in). As discussed previously, many of the connecting positions are bonded by welding while others include securing bolts 28. For many applications it may be desirable to paint the components of the apparatus 10 or to provide anticorrosive coatings, but this is not critical to the invention.

Various alterations of the components may be utilized without degrading the performance of the invention. For example, although the preferred embodiment utilizes a thrust bearing for the rotational support bearing 74, other types of bearings may be substituted. Similarly, the preferred rollers 64 are in the nature of cam follower bearings but other types of rollers or bearings could be utilized with equally successful effect.

Various other modifications and alterations of the apparatus and components may be made without departing from the invention. Those skilled in the art will readily recognize additional embodiments and uses. Accordingly, the above disclosure is not to be construed as limiting and the appended claims are to be interpreted as encompassing the entire spirit and scope of the invention.

INDUSTRIAL APPLICABILITY

The storage and access apparatus 10 of the preferred embodiment and the double tiered storage apparatus 510 of the alternate embodiment of the present invention are particularly adapted for use in industrial applications involving massive cylindrical objects. The primary expected use of the apparati 10 and 510 is with compressed gas cylinders 13 utilized in various welding and metal working, chemical and manufacturing operations. The apparati of the present invention are adapted for storing the gas cylinders 13 in a compact, safe and readily accessible manner.

In order to use the present invention the end user will receive the apparatus 10 in a disassembled mode with each of the vertical tiers being knocked down in such a fashion that it may be easily shipped in a compact manner. Assembly may proceed in a straight forward fashion with the arrangement of components being as described above.

For typical shipment, the base plate 18, base ring 20 and associated elements will be a single unit while each tier of the carousel 16 will be separate and the vertical members such as the center pillar 44, the center port 40 and the support posts 26 will be unassembled. It is contemplated that the user will first completely assemble the carousel 16 by attaching the lower carousel module 46 and the upper carousel module 48 to the center pillar and then moving the entire carousel 16 into position upon the seating column 36 and the thrust bearing 42. The center post 40 will then be inserted vertically through the bolt aperture 71 and screwed into the threaded aperture 38. The insertion of the rotational support bearing 74 and tightening of the top nut 76 complete the assembly.

Once the device has been assembled and either secured in place within the facility or placed on a rolling dolly 5120 or similar implement it is ready to receive gas cylinders 13.

The user will transport a gas cylinder 13 to the vicinity of the storage and access apparatus 10 and open the gate member 34. The carousel 16 will then be rotated such that one of the support chambers 52 is aligned with the front opening 22 in the orientation shown in FIG. 3. At this point the hook 90 will be detached from the hook aperture 92 and will be hanging down as shown in FIG. 2. The user will then lift the cylinder slightly and place it such that the base of the cylinder 13 fits within the support chamber 52 while the upper portion of the cylinder is partially surrounded by the receiving niche 78. The enclosing strap 88 is then stretched across in front of the receiving niche 78 and is attached by inserting the hook 90 into the hook aperture 92 such that the upper portion of the cylinder 13 is surrounded. The user will then rotate the carousel 16 one-fourth turn such that a new and empty support chamber 52 is aligned with the front opening 22 and repeat the operation until all of the support chambers 52 are full. The carousel will then be turned an additional 45' (one-eighth turn) so that it is in the orientation illustrated in FIG. 4. At this point the gate mechanism 34 is closed with the lateral plate 110 extending between the cylinders **13*a* and 13*d*** so as to prevent any rotation of the carousel while the gate is in the closed position.

It is expected that the most efficient of utilizing the storage and access apparatus 10 is that the cylinder represented in FIG. 4 by **13*d* will be the cylinder actually utilized at any given time. In this manner when the contents of cylinder 13*d* are exhausted it is in position to be turned only a short distance and removed. It is to be remembered that the ratchet latch mechanism 66 permits the carousel 16** to be turned only in clockwise direction. Therefore, it is difficult for the user to accidentally turn the wrong direction and remove the wrong cylinder. This arrangement particularly encourages an FIFO utilization pattern for the gas cylinders in that it minimizes the likelihood of a cylinder being forgotten and remaining unused beyond its stated useful period.

For all of the reasons stated above and the advantages discussed previously, it is expected that the storage and access apparatus of the present invention in manufacturing, repair, metal working, and chemical dispensing applications of various types. The compact usage and the enhanced safety features provided by the fail safe supports make the device particularly valuable in handling hazardous materials. Accordingly, the commercial viability and industrial applicability of the invention is expected to be substantial and widespread.

We claim:

1. A rotational containment device especially adapted for use with elongated cylindrical objects in a vertical array, comprising:

a fixed base plate element;

a rotational support bearing structure mounted upon the base plate element, for rotating about vertical axis;

a support carriage mounted upon the support bearing structure so as to rotate therewith, the support carriage including a plurality of radially arrayed discrete chambers, each chamber being adapted for supporting and partially enclosing the bottom of one of the objects, each of said radially arrayed discrete chambers being open on its radially outward facing side and further includes a bottom plate and an array of vertically upstanding wall panels to prevent the bottom of the object from having freedom of movement except toward said open side; and a open stationary external support frame mounted upon the base plate and radially surrounding the support carriage, the open stationary external frame including a partially enclosing ring frame member supported above the base plate at a height intermediate the center of mass of the objects and the tip of the objects, a portion of the partially enclosing ring frame member including a gate element providing access to the objects.

2. The rotational containment device of claim 1 and further including:

rotational restriction means for restricting the rotation of the support carriage to a single rotational direction past a plurality of discrete rotational positions, each of said rotational positions corresponding to one of said chambers being radially aligned with said gate element.

3. The rotational containment device of claim 1 wherein:

said gate element restricts said enclosing ring such that when said gate element is closed it will abut against a cylindrical object within one of said chambers if the support carriage is rotated when one or more of said chambers contains such an object.

4. The rotational containment device of claim 1 wherein the support carriage further includes a plurality of rollers spaced about the lower periphery thereof, said support rollers being adapted to roll upon the base plate so as to facilitate rotation of the carriage and to provide balanced support thereto.

5. The rotational containment device of claim 1 wherein the support carriage is quadrilaterally symmetrical about a central vertical axis.

6. The rotational containment device of claim 1 wherein the external support frame further includes a base ring member extending circumferentially about the greater part of the support carriage and being vertically aligned with said chambers.

7. The rotational containment device of claim 1 wherein said enclosing ring extends about 300 of arc of a circle and said gate element extends along the chord of the remaining portion of said circle.

8. The rotational containment device of claim 1 wherein the base plate element is secured to a rolling dolly such that the containment device may be readily rolled from one position to another without disturbing the objects.

9. The rotational containment device of claim 1 wherein the support carriage includes both a lower tier and an upper tier, with each tier having a plurality of radially arrayed chambers, so that the upper tier will support a second set of objects at positions above the objects supported by the lower tier.

10. The rotational containment device of claim 1 and further including upper object restriction means for enclosing an axial portion, situated above the center of mass thereof, of the object so as to prevent the object from tipping.

11. The rotational containment device of claim 10 wherein said upper object restriction means includes a plurality of receiving niches, congruently arrayed above said chambers, each said receiving niche including a radially outward facing opening, said opening being closable by openable enclosing means.

12. A storage and access apparatus adapted to support industrial gas cylinders, comprising:

an open stationary frame including a fixed base plate, central axis rotational support means, and radially surrounding frame means, said radially surrounding frame means including an occludable opening therein and gate means for selectively closing said occludable opening; and a rotating carousel member situated radially within said surrounding frame means, the carousel member including a center pillar extending vertically about said central axis, a first tier of discrete individual cylinder support chambers secured to the lower end of said center pillar, and upper cylinder restriction means for restricting lateral movement of the upper portion of cylinders having the bottoms thereof situated within said support chambers.

13. The apparatus of claim 12 wherein said central axis rotational support means includes a stationary center post and one or more thrust bearings for supporting said center pillar of the carousel member about said center post such that the carousel member freely rotates thereabout.

14. The apparatus of claim 12 wherein the number of each of said support chambers is four; and said upper cylinder restriction means is in the form of an array of niches, each said niche having a radially outward facing opening and an array of side ad radially inward situated walls to prevent tipping of the gas cylinder, each said niche further being provided with closure means for selectively closing said outward facing opening so as to entrap the gas cylinder, and each said niche being aligned vertically above a corresponding one of said support chambers.

15. The apparatus of claim 12 wherein said first tier of cylinder support chambers includes a bottom plate and a plurality of vertical panels secured to said bottom plate so as to define said chambers.

16. The apparatus of claim 15 and further including a second tier of cylinder support chambers, similar to said first tier, said second tier being secured to said center pillar above said first tier by a distance greater than the height of the cylinders to be supported therein.

17. The apparatus of claim 12 wherein said radially enclosing frame means includes:

a bottom ring member secured to said base plate, said bottom ring member including a front opening formed therein;

a plurality of support posts secured to said bottom plate and extending upward therefrom;

an enclosing support ring mounted upon said support posts at a vertical position above the center of mass of the gas cylinders supported by the carousel member, said enclosing support ring including a front gap generally vertically aligned with said front opening; and said gate means is in the form of a gate member pivotally attached to said enclosing support ring, said gate member being adapted to selectively occlude said front gap.

18. The apparatus of claim 17 wherein said gate member includes an inwardly extending flange formed thereon, said flange being adapted to protrude between two of the cylinders when said gate member is in a closed position, thereby preventing rotation of the carousel member when the carousel member is loaded with cylinders and said gate member is in said closed position.

19. The apparatus of claim 18 wherein corresponding ratchet means are provided on the carousel member and on the stationary frame for permitting the carousel member to rotate past the juxtaposition of said corresponding ratchet means in only a single rotational direction.

* * * * *